United States Patent [19]

Hartig

[11] 3,943,905

[45] Mar. 16, 1976

[54] METHOD AND DEVICE FOR IGNITING COMBUSTIBLE SUBSTANCES

[76] Inventor: Gunter Hartig, Hansastrasse 29, Karlsruhe 21, Germany, D-7500

[22] Filed: Mar. 25, 1974

[21] Appl. No.: 454,738

[30] Foreign Application Priority Data

July 27, 1973 Switzerland ..... 11022/73

[52] U.S. Cl. ..... 123/148 CA; 123/148 CC

[51] Int. Cl.[2] ..... F02P 1/00

[58] Field of Search ..... 123/148 ICD, 148 MCD; 315/209 R

[56] References Cited

UNITED STATES PATENTS

| | | | |
|---|---|---|---|
| 2,977,507 | 3/1961 | Short | 315/209 R |
| 2,985,797 | 5/1961 | Williams et al. | 123/148 ICD |
| 3,134,048 | 5/1964 | Wolffram et al. | 123/148 ICD |
| 3,169,212 | 2/1965 | Walters | 123/148 ICD |
| 3,357,415 | 12/1967 | Huntzinger | 123/148 ICD |
| 3,545,420 | 12/1970 | Foreman | 123/148 MCD |
| 3,587,550 | 6/1971 | Zechlin | 123/148 MCD |
| 3,623,466 | 11/1971 | Palmer | 123/148 ICD |
| 3,677,255 | 7/1972 | Withem | 123/148 ICD |

FOREIGN PATENTS OR APPLICATIONS

| | | | |
|---|---|---|---|
| 1,389,275 | 1/1965 | France | 315/209 R |

*Primary Examiner*—Wendell E. Burns
*Assistant Examiner*—Paul Devinsky
*Attorney, Agent, or Firm*—Toren, McGeady and Stanger

[57] ABSTRACT

The invention provides means to produce a spark for firing a mixture in an internal combustion, wherein the spark has a high steep voltage wave front followed by an elongated tail of lower voltage, by providing an induction coil, a capacitative voltage source and an inductive voltage source, and means for suitably applying both sources in parallel to the induction coil primary when a spark is required. Several alternative circuits are described, a capacitor providing the high voltage short duration wave front to initiate the spark, while an inductor, which may be part of a transformer supplies the longer duration low-voltage tail. The voltage to charge the capacitor may be derived by rectifying the output voltage of a step-up charging transformer.

8 Claims, 18 Drawing Figures

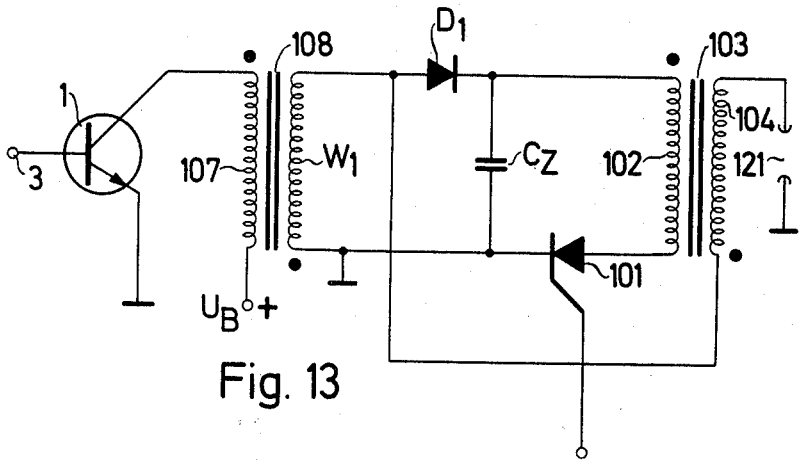
Fig. 13
Fig. 14
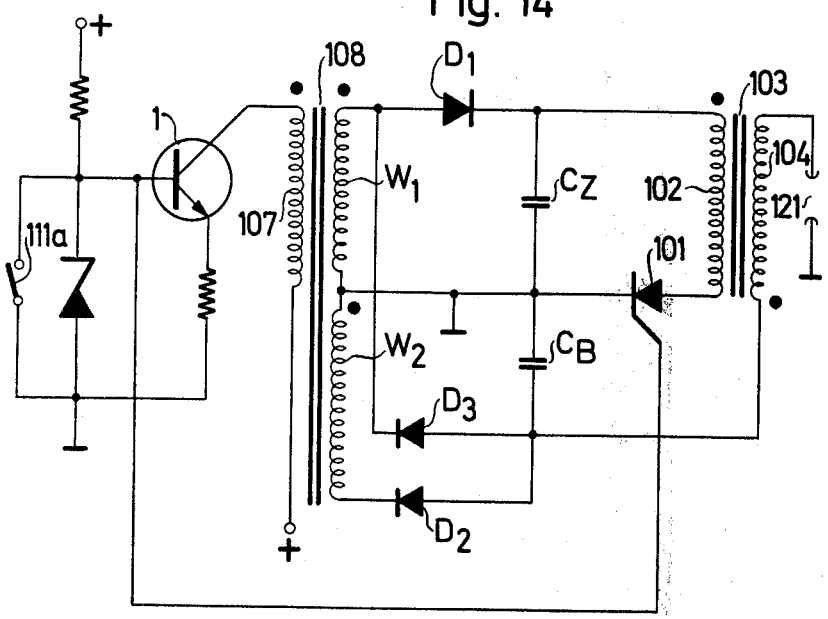

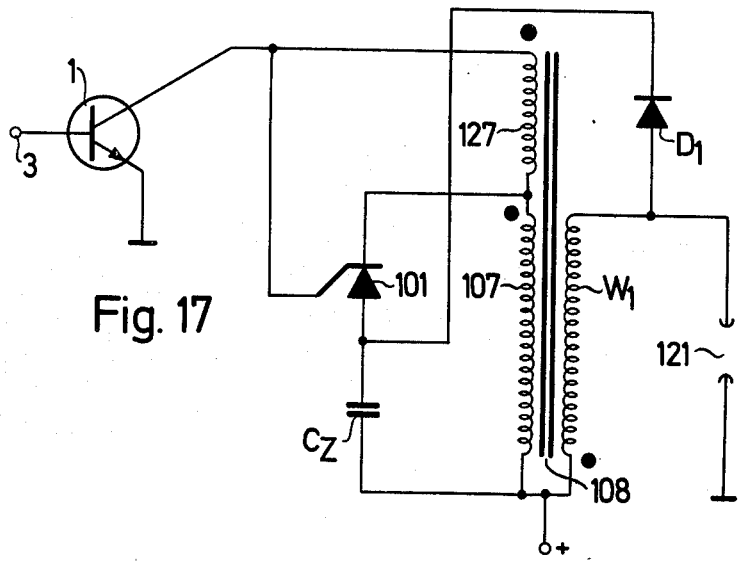
Fig. 17
Fig. 18
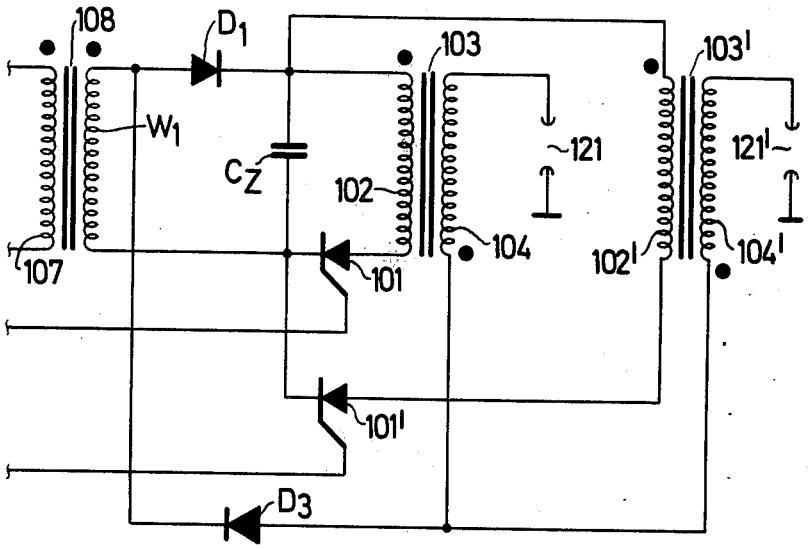

METHOD AND DEVICE FOR IGNITING COMBUSTIBLE SUBSTANCES

Prior Application: In Switzerland on July 27th, 1973 No. 11 022/73.

The present invention concerns a method and device for producing ignition pulses, more particularly for the ignition of combustible matters such as gas and air mixtures in internal combustion engines, by spark discharge.

In industry, sparks for igniting combustible substances, principally gas and air mixtures, are often required, particularly for internal combustion engines and oil burners. The spark energy required for the purpose is obtained by means of ignition systems in which either the rapid collapse of a magnetic field in an induction coil and the resultant induced voltage peak are used, as for example in coil ignition, or in which the electrical energy stored in a capacitor is discharged by means of a spark gap at the moment of ignition, as in high tension capacitor ignition, a pulse transformer being interposed in some cases.

Hitherto the above-mentioned coil ignition and the high-tension capacitor ignition have mainly been used for ignition pulse production, particularly for the operation of internal combustion engines in motor vehicles. However, coil ignition (and transistor controlled coil ignition) has the disadvantage that it only produces a slow rise in the high voltage wave front, whilst with high-tension capacitor ignition a rapid voltage rise is achieved, but the shorter duration of the resultant spark discharge is a disadvantage compared with the spark duration achieved by coil ignition and transistor coil ignition.

However both a rapid voltage rise and a long duration of the spark discharge are desired. In order to achieve this, it has been proposed to steepen the voltage rise in coil ignition and transistor coil ignition by providing a spark gap in series with the spark plugs, on the high tension side. However, the spark gap contacts tend to burn off rapidly and, in addition, severe high-frequency interference occurs; furthermore, the build-up of the high tension is adversely affected by possible shunts, such as dampness in the spark distributor.

The above-mentioned conditions may be represented in the following manner, if a spark discharge is considered per se;

During the discharge process a spark front is initially produced at the spark gap, i.e., an initial time of the spark discharge which is distinguished by a high discharge voltage and comprises the ignition period of the spark discharge and a time interval which immediately follows the ignition period.

The spark front is followed by a spark tail, i.e., the time of the spark discharge following the front in which there exists a comparatively low combustion voltage and which terminates with the extinction of the spark discharge. Since the spark front includes the time when ignition takes place, a high ionisation voltage with rapid voltage rise is desired for the formation of the spark front, so that reliable ignition is achieved under comparatively unfavourable conditions (sooted-up spark plugs, moisture in the combustion chamber or the like). In addition, the spark discharge should have a relatively long spark tail, so that, even under unfavourable igniting conditions (for example, poor mixing of the constituents of a gas and air mixture to be ignited) a sufficiently long action of the spark discharge and, consequently, reliable ignition of the combustible substance is ensured. As already indicated above, none of the types of ignition mentioned simultaneously fulfil these two essential conditions.

It is therefore an object of the present invention to provide a method and a device for the production of ignition pulses by which both a rapid voltage rise at the beginning of the spark discharge and also a long spark duration after the start of the spark discharge are achieved.

According to the present invention there is provided a method of igniting combustible substances such as gas and air mixtures in internal combustion engines, by spark discharge across a gap, including the step of initiating simultaneously or sequentially the discharge of an electric source of a capacitive character connected to a spark discharge gap and the discharge of an electric energy source of an inductive character also connected to said spark discharge gap, so that the energy for initiating or starting the spark discharge, i.e., for producing the spark front is derived mainly from the energy source of capacitive character, and the energy for maintaining the spark discharge, i.e., for producing the spark tail, is delivered mainly from the energy source of inductive character.

Further according to the present invention there is provided a device for carrying out the method, including the combination of at least one energy source of capacitive character coupled to the circuit of a spark discharge gap and at least one energy source of inductive character also connected to the circuit of the spark discharge gap.

By an energy source of capacitive character, an energy source is to be understood, whose energy is stored in the form of an electric field, e.g. in a capacitor; however, it may also be a battery or an accumulator, if these items are considered as large capacitors. On the other hand, by an energy source of inductive character, an energy source is to be understood whose energy is stored in the form of a magnetic field and/or is controlled by means of an inductance.

By the means of the present invention, ignition pulses may be obtained which have a very steep voltage rise derived from the energy source of capacitive character and therefore render possible reliable initiation of the spark discharge, and which also, due to the energy source of inductive character, renders possible reliable firing of the substance to be ignited by the spark discharge.

Reference is now made to the accompanying drawings, which concern embodiments of the present invention, and in which:

FIGS. 11 – 14 show other embodiments of the present invention;

14, but is simpler, and

FIGS. 17 and 18 show other embodiments of the present invention.

Figure 1:
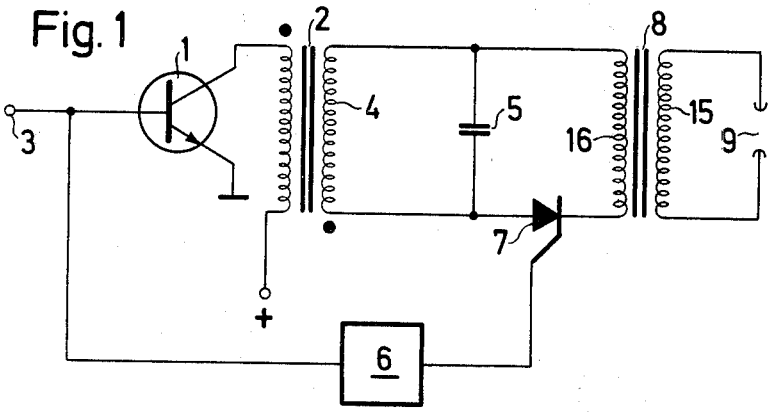
FIG. 1 shows a first embodiment of the present invention.

The first embodiment of the present invention shown in FIG. 1 comprises a power transistor 1, the collector of which is in series with the primary winding of a charging transformer 2. When transistor 1 is turned on by current supplied to its input 3, a magnetic field is built up in the transformer 2 which, when the collector current is switched off by transistor 1 collapses and induces, in the secondary winding 4, a voltage which charges capacitor 5. During the charging of capacitor 5, the sum of the magnetic field energy in the transformer 2 and of the electrical energy in the capacitor 5 remains substantially constant, so that the capacitor energy increases during the charging of the capacitor with increasing time, at the cost of the magnetic field energy.

Figure 2:
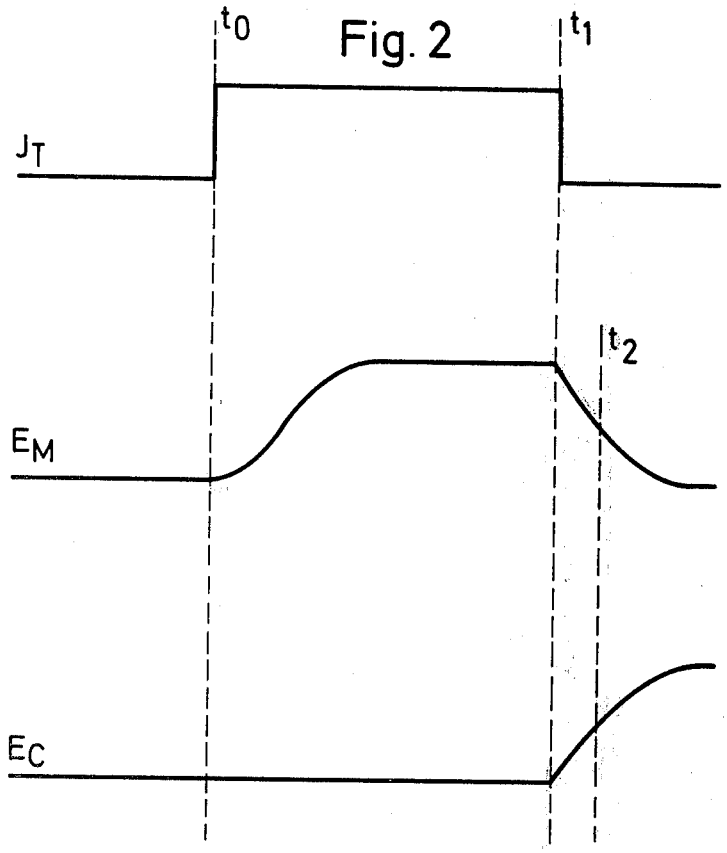
FIG. 2 is a graph explaining the circuit arrangement according to FIG. 1.

These circuit conditions are shown in FIG. 2 to a time base, where $I_T$ is the control current of transistor 1 occurring at the input 3; $E_M$ is the instantaneous magnetic field energy in the transformer 2 and $E_C$ is the instantaneous energy in the capacitor 5. At the time $t_0$ transistor 1 is turned on, whilst at the time $t_1$ transistor is switched off. Between the time $t_0$ and $t_1$, the magnetic energy $E_M$ reaches a saturation value. At the time $t_1$, the magnetic field begins to collapse, whilst the charge in the capacitor 5 begins to rise, so that $E_C$ increases to a maximum value.

At a certain moment of time $t_2$ after the switching off of the primary current in the transformer 2, the energy in the circuit is uniformly divided between the magnetic field of the transformer and the electrical field of the capacitor 5.

If, therefore, at this moment $t_2$, a thyristor 7 is ignited by a control circuit 6 so that the primary winding of the ignition coil 8 is connected to the secondary winding 4 of the charging transformer 2 and the capacitor 5 in parallel, the capacitor 5 suddenly discharges through the ignition coil 8, so that a steep voltage front occurs across the spark gap 9 and starts a spark; the discharge of the capacitor determines the form of the spark front in this case. On the other hand, the energy required during the remainder of the spark discharge, i.e., for the tail of the spark, is supplied by the magnetic energy from the charging transformer 3.

By changing the time $t_2 - t_1$ and by a suitable choice of the capacitor 5, any desired ratio of spark front to spark tail energy, and the height of the voltage rise at the spark front, can be secured.

Figure 3:
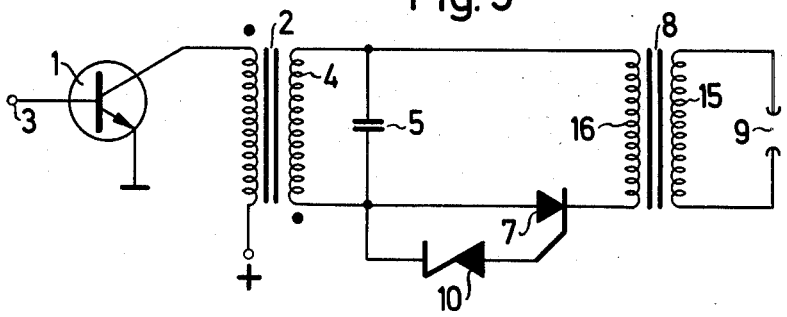
FIGS. 3 – 8 show more embodiments of the present invention.

The embodiment of the present invention shown in FIG. 3 corresponds substantially to the embodiment shown in FIG. 1, but, differs therefrom in that the control generator 6 is replaced by a zener diode 10 which is connected between the anode and the control electrode of the thyristor 7. By this means, the thyristor is ignited at a voltage determined by the zener diode 10, so that the height of the rapid voltage rise at initiation of the spark at the spark gap 9 becomes independent of the ignition energy within certain limits, so that a reduction in energy from the charging transformer 3 leads to shortening of the spark tail.

Figure 4:
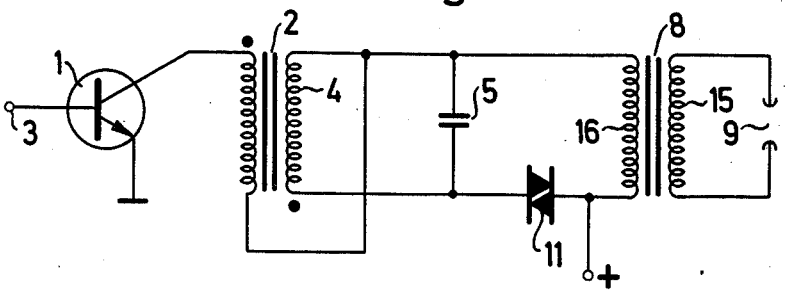

The embodiment shown in FIG. 4 differs from the previous embodiments in that, in addition to the charging transformer 2, the ignition coil 8 is also utilised as an energy storage for supplying the spark energy. For this purpose, the primary windings of the charging transformer and ignition coil are in series during the flow of current through transistor 1. The energy stored in the ignition coil 8 therefore increases the energy for the spark front and tail in this embodiment. In the circuit according to FIG. 4, a diac 11 (multi-layer diode) is used instead of the thyristor 7 and the zener diode 10 to perform the same function in the circuit of the primary winding of the ignition coil 8.

Figure 5:
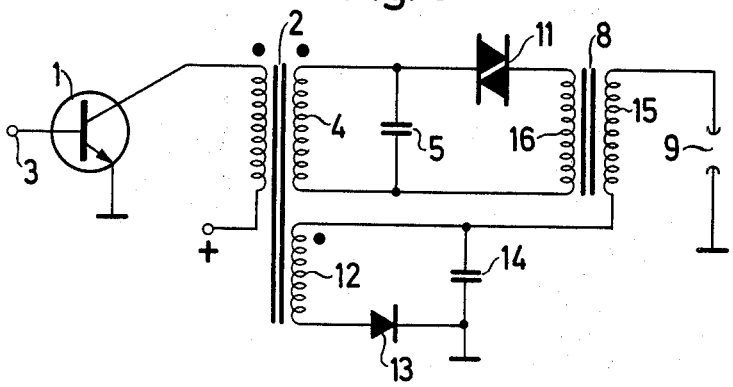

FIG. 5 shows an embodiment of the present invention which a voltage of approximately 1 – 2 kV is produced by an additional winding 12 on the charging transformer 3, this voltage charging capacitor 14 by means of diode 13. By connecting the capacitor 14 in series with the spark gap 9 through the secondary winding 15 of the ignition coil 8, the latter capacitor supplies most of the energy for the spark tail, the inductive character of the voltage source for the spark tail being achieved by the inductive throttling effect of the secondary winding 15. Consequently, the ignition coil 8 is required principally to supply the rapid voltage rise by which a spark is initiated in the spark gap 9, and therefore this ignition coil can be made smalleer. smaller.

In the embodiment according to FIG. 5, the diode 13 itself is only necessary when the capacitor 14 is relatively large, so that it prevents current flowing backwards into the winding 12 from the capacitor which is not completely discharged after the collapse of the spark thus producing "ringing" or current alternations.

Figure 6:
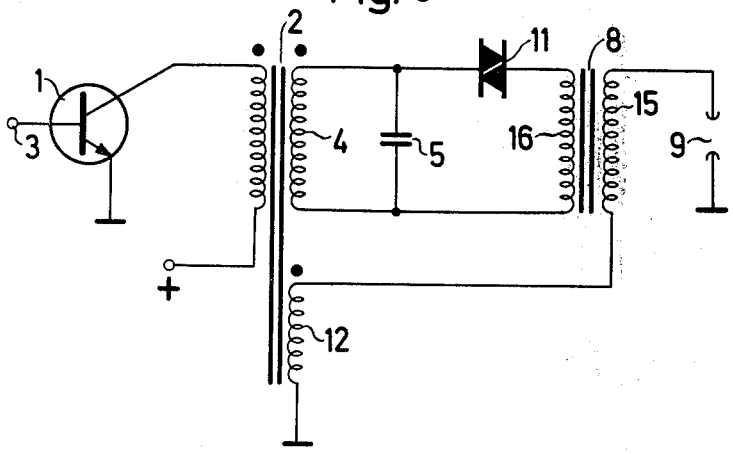

The embodiment of FIG. 6 differs from the embodiment of FIG. 5 in that the diode 13 and the capacitor 14 are omitted and therfore the energy for the spark tail is supplied directly from the additional winding 12 which is connected in series with the secondary winding 15 of the ignition coil 8, from collapse of the magnetic field of the charging transformer 2 when transistor 1 is switched off.

Other embodiments of the present invention are described in greater detail with reference to FIGS. 7 to 9. Whilst in the embodiments according to FIGS. 1 to 6, the ignition process was initiated by the collapse of a magnetic field, in the embodiments according to FIGS. 7 and 8, the initiation of the ignition process is effected at the beginning of the build-up of the magnetic field in the charging transformer 108. Both embodiments according to FIGS. 7 and 8 share the common feature that, upon the collapse of the magnetic field in the charging transformer 108, some of the released energy is stored in the ignition capacitor $C_Z$. This storage of energy is achieved from a voltage induced in a secondary winding $W_1$ of the charging transformer which charges the ignition capacitor $C_Z$ through diode $D_1$, this diode $D_1$ preventing current reversal, so that energy storage is maintained until the ignition capacitor $C_Z$ is discharged through a thyristor 101 and the primary coil 102 of the ignition coil 103. Due to the discharge, a very steep pulse of high voltage $U_F$ (for example 20 kV), which initiates a spark discharge in the spark gap 121, is produced by the secondary winding 104.

Figure 7:
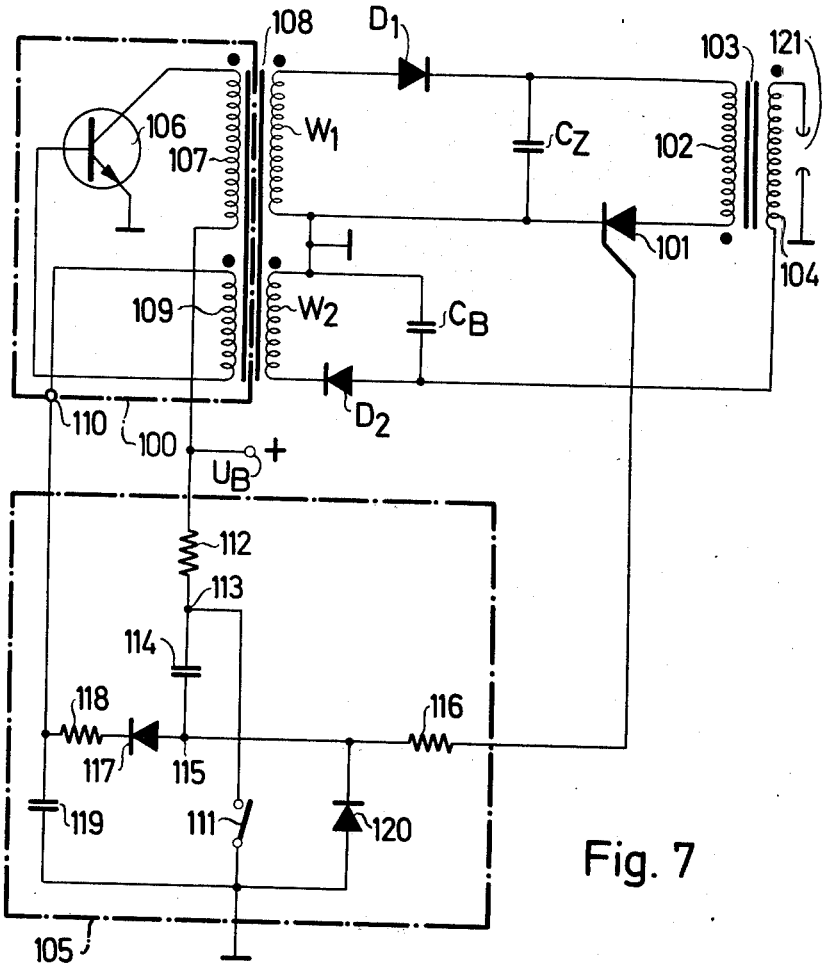
Figure 8:
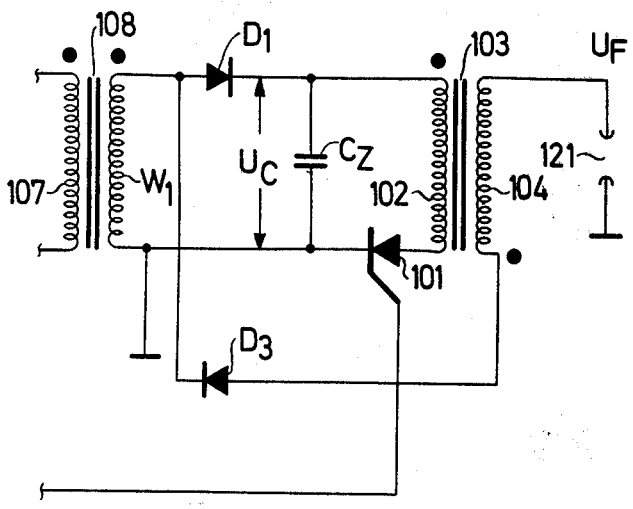

Both the embodiments of FIGS. 7 and 8 use a converter 100 and a pulse generator 105 and therefore these parts of the circuit are not shown in FIG. 8.

The converter 100 comprises a power transistor 106 the collector-emitter path of which, together with a current source, is connected in series with a primary winding 107 of the charging transformer 108; a feedback winding 109 is provided on the charging transformer and is connected at one end to the base of the transistor 106, whilst its other end extends to the input terminal 110. The converter can be switched on by a positive pulse to the input 110; during the switched-on condition it delivers to this input 110 a negative voltage induced in the feed-back winding 109. The converter receives its energy from the terminal $U_B$ which is connected to one end of the primary winding 107.

The control of the entire device is effected by means of the pulse generator and trigger unit 105, the control member of which is a mechanical circuit breaker 111, which may of course, be replaced by an electronic switch. The circuit breaker 111 receives a positive potential from the voltage source $U_B$ via series resistor 112, so that when the circuit breaker 111 is opened, the voltage at the point 113 jumps to the level of the voltage $U_B$. This positive voltage jump is transmitted through the capacitor 114 and reaches the point 115 whence it passes through resistor 116 as a firing pulse to the ignition electrode of the thyristor 101. The positive voltage pulse also passes from the point 115 through the diode 117 and the resistor 118 to the input terminal 110 and triggers the switching-on of the converter 100. The capacitor 119 connected to input terminal 110 and to earth, is charged by the negative voltage present at the input terminal 110 during the switched-on time of the converter and thus prevents automatic triggering of the converter by the tail end of the pulse produced by the collapse of the magnetic field; this negative voltage is cancelled only by the positive voltage surge which is supplied from the point 113.

The diode 120, located between earth and the point 115, discharges capacitor 114 when the circuit breaker 111 is closed.

The magnetic field which is built up in the charging transformer 108 when the circuit breaker 111 is closed, collapses after a predetermined time which is substantially determined by the dimensions of the transformer and the capacitor 119. Upon the collapse of this magnetic field a voltage pulse is produce not only, as already described above, in the secondary winding $W_1$ of the charging transformer, but also in the other secondary winding $W_2$ which is provided in the embodiment of FIG. 7 but has many more turns than the first secondary winding $W_1$, for example, ten times the number of turns. Thus the capacitor $C_B$ connected in the series through the diode $D_2$ to the secondary winding $W_2$ receives a charging voltage which amounts to approximately 10 times the value of the charging voltage of the ignition capacitor $C_Z$, (for example, the latter charges to 400 volts, whilst the capacitor $C_B$ charges to 4 kV). The energy stored in the capacitor $C_B$ is used up during the firing of the spark gap 121, an inductive form of discharge from the capacitor $C_B$ being achieved in the spark gap and the capacitor $C_B$ connected in series therewith, by the series connection of the secondary winding 104 of the ignition transformer, so that stabilisation of the discharge and a long duration of spark are achieved.

Figure 9:
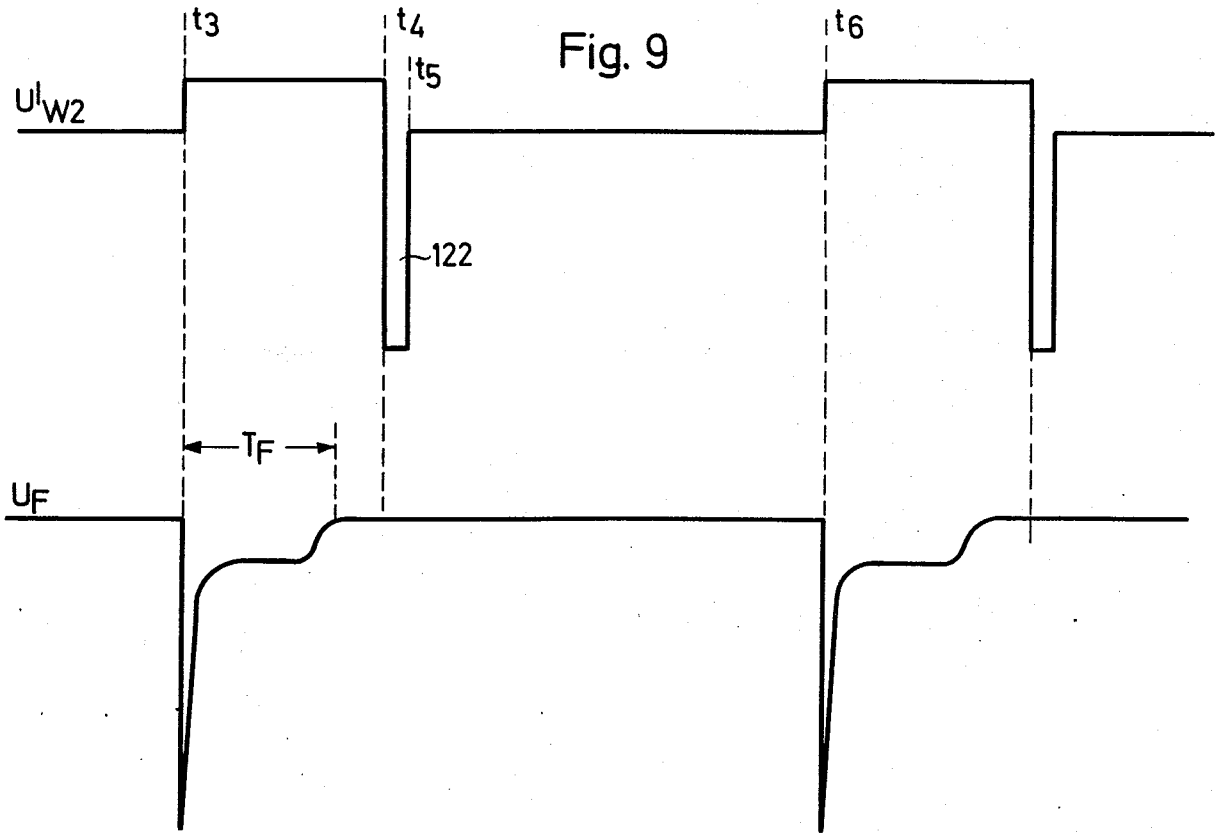
FIG. 9 is a graph explaining the mode of operation of the circuit arrangement according to FIG. 7.

The voltage ratios are shown in FIG. 9, the voltage $U'_{w2}$ of the secondary winding $W_2$ (without considering the loading of the capacitor $C_B$) being shown in the upper part of this figure and the voltage $U_F$ across the spark gap 121 in the lower part. The circuit breaker 111 opens at the time $t_3$, triggering thyristor 101, so that a spike pulse of the voltage $U_F$ is produced at the point $t_3$, which initiates the spark. At the same time, on account of the switching-on of the converter 100 at the time $t_3$, a negative voltage spike occurs which, has no effect because of the diodes $D_1$ and $D_2$. This negative voltage $U'_{w2}$ continues from winding $W_2$ until the transformer 108 is saturated and the operating transistor 106 is blocked at the time $t_4$. The difference in time between $t_3$ and $t_4$ is, as already mentioned above, determined by the dimensions of the charging transformer, the resistance of the winding 109 and the value of the capacitor 119. This time difference is selected so that it is greater than the duration of time $T_F$ of the spark discharge, the latter being determined by the time constant which results from the value of the capacitor $C_B$, its charging voltage, and the inductance of the secondary winding 104. When the transistor 106 blocks at the moment $t_4$, due to the collapse of the magnetic field in the charging transformer a positive voltage pulse 122 appears which lasts for the time $t_5 - t_4$ and, as already mentioned, charges both capacitors $C_Z$ and $C_B$ again, so that, at the next ignition moment $t_6$ at which the circuit breaker 111, which has since closed again, has reopened, a new spark ignition pulse can take place.

In this embodiment, the converter 100 is operated as a blocking converter, i.e., it gives up its energy only at the blocking moment, this energy depending only on the current in the primary winding 107 and can be made independent of the operating voltage $U_B$ by a suitable circuit. Thus the same amount of energy is always available for the spark.

A more detailed description of the embodiment of FIG. 8 is given below, in which both the converter and the trigger member are similar to the circuit components 100 and 105 in FIG. 7.

The essential difference between FIGS. 7 and 8 is the feature that the diode $D_2$ of FIG. 7 is of reversed polarity, the capacitor $C_B$ is omitted, and the direction of winding of the secondary coil 104 of the ignition coil is reversed, so that the secondary winding 104 has its direction of winding opposed to the primary winding 102. The embodiment of FIG. 8 may also include a separate second secondary winding $W_2$ of the charging transformer (after making the above alterations). The embodiment according to FIG. 8, however, is simplified further in that the winding $W_1$ also fulfills the function of the winding $W_2$ shown in FIG. 7. For this purpose one end of the winding $W_1$ is connected to the diode $D_1$ and to the diode $D_3$ and thence to the secondary winding 104 of the ignition coil and the spark gap 121.

In this case it is necessary to select the transformation ratio U between the primary winding 107 and secondary winding $W_1$ so that when the converter 100 is switched on, sufficient voltage is produced to produce the necessary spark tail. At the same time, the capacitor $C_Z$ is calculated so that it is charged by the energy of the blocking pulse (the pulse produced in the winding $W_1$ during the blocking of the transistor 106) to a voltage, for example 400 volts, which is sufficient to deliver a spark initiation pulse with the necessary high voltage from the ignition coil.

Figure 10:
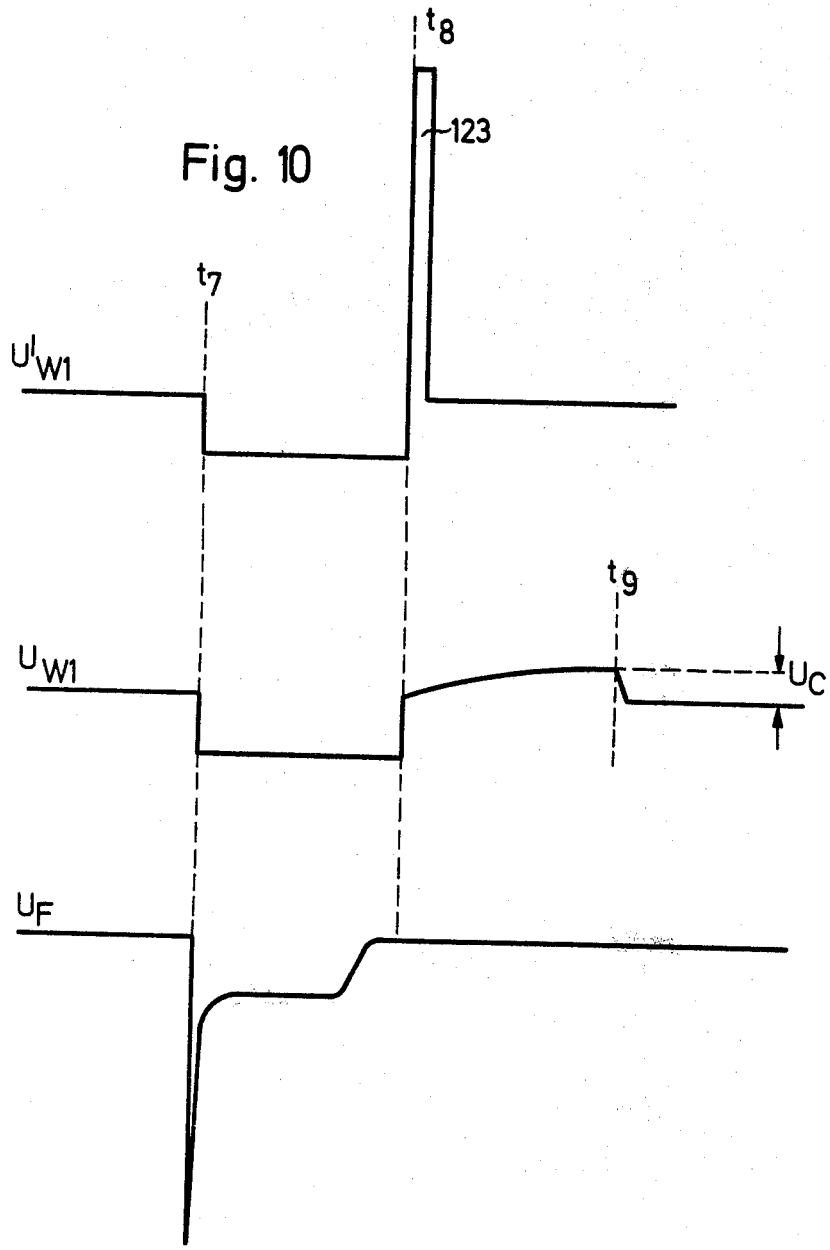
FIG. 10 is a graph explaining the mode of operation of the circuit arrangement according to FIG. 8.

A voltage-time graph is shown in FIG. 10, the voltage $U'_{w1}$ i.e., the voltage from the winding $W_1$, being reproduced in the upper part, on the assumption that the winding is open; whilst the voltage $U_{w1}$ actually produced from the winding $W_1$ is shown in the centre of FIG. 10, and the lower part shows the output voltage $U_F$ at the spark gap 121. At the moment $t_7$ the converter 100 is switched on so that a spark initiation voltage $U_F$ of 25 kV is obtained, which ignites the spark. At the same time the voltage produced from the winding $W_1$ when the converter is switched on, maintains the spark discharge through the diode $D_3$ and the secondary winding 104 of the ignition transformer. When the converter 100 is switched off, a blocking pulse 123 is produced in the winding $W_1$ at the time $T_8$ and charges the capacitor $C_Z$ to the voltage $U_C$, so that it reaches the necessary charging voltage of 500 volts at the time $t_9$. When the converter 100 is switched on again, this cycle is repeated.

The advantage of the embodiment shown in FIG. 8 compared with that of FIG. 7, resides in the feature that a longer spark combustion or tail time is ensured with a constant tail voltage during the entire switching-on phase (period between $t_7$ and $t_8$), because the tail voltage does not sink, due to the discharge of the capacitor $C_B$.

Figure 11:
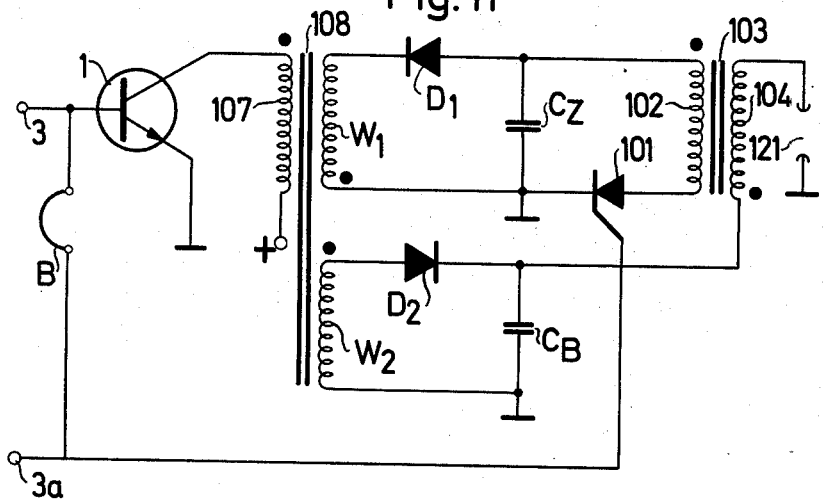
Figure 12:
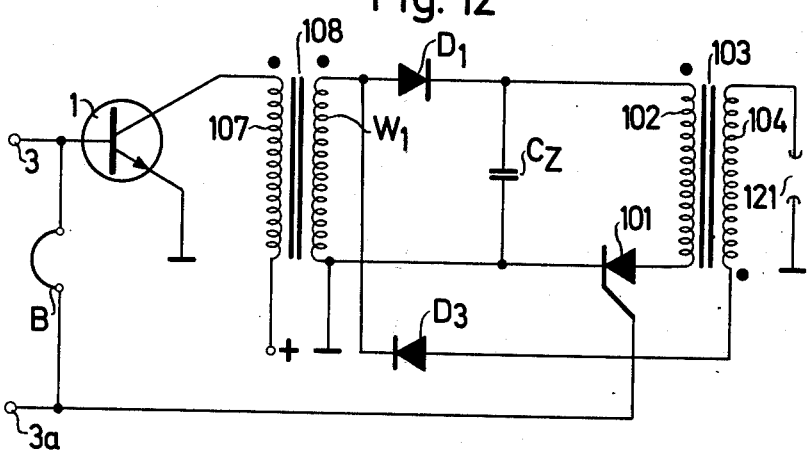

Finally, FIGS. 11 and 12 show embodiments corresponding in principle to the embodiments of FIGS. 7 and 8, in which however the control of the switching-on of the primary winding of the charging transformer is effected externally by a transistor 1 and also the firing of the thyristor 101 (as shown in connection with the primary circuit of the charging transformer and the control of the thyristor discharge in FIG. 1).

In FIGS. 11 and 12 the primary circuit of the charging transformer is such that a control pulse at the input 3 simultaneously reaches the base of the power transistor 1 and the control electrode of the thyristor 101, so that at the moment transistor 1 is switched on, thyristor 101 is also ignited by means of an external control e.g. by a small computor.

The advantage of the control shown in FIGS. 11 and 12 as compared with the embodiments of FIGS. 7 and 8 is that the switching-off of the converter and the primary winding 107 can be started immediately after the extinction of the spark discharge, through the external control, i.e., the blocking pulse at the moment $t_4$ or $t_8$ (FIGS. 9 and 10) is not triggered just when the charging transformer 108 becomes saturated. Thus the switching-on time of the primary winding is limited to the shortest possible duration and the energy of the current source is optimally utilised. This linking of the moment $t_4$ or $t_8$ to the end of the spark discharge is a great advantage in connection with different spark discharge periods which occur under various ignition conditions in the internal combustion engine.

In the embodiments of FIGS. 11 and 12, the control of the initiation of the spark discharge and the control of the switching-on of transistor 1 may be effected separately at terminals 3*a* and 3 by removing the bridge B, or in a predetermined time sequence, for which purpose a time delay component is inserted in place of the bridge B. In this manner it is possible to effect the initiation of the spark with a predetermined time lag relatively to the switching-on of the charging transformer 108, between $t_3$ and $t_4$ or $t_7$ and $t_8$. In the embodiment of FIG. 11 in which the energy for the spark tail is taken from the blocking pulse 123 (FIG. 10), it is also possible to trigger the spark discharge at any point between two energy-transmitting blocking pulses 123.

The embodiment of FIG. 13 is similar to one of the embodiments of FIG. 8 or 12, but it differs from these in that the charging of the ignition capacitor $C_Z$ takes place during the switching-on or conducting phase of the charging transformer 108, whereas the ignition of the spark discharge is initiated by the blocking pulse. For this purpose the direction of the primary winding $W_1$ is reversed as compared with the embodiments of FIGS. 8 and 12 (indicated by dots on the windings); furthermore, the diode $D_3$ is omitted, because the voltage surge occurring when the charging transformer is switched on, is not sufficient to initiate the spark discharge, i.e., non-conducting spark gap 121 assumes the function of the diode $D_3$.

The embodiment of FIG. 14 represents a combination of the embodiments of FIGS. 7 and 8 so far as the circuit arrangement of the secondary side of the charging transformer 108 is concerned, whilst the primary side arrangement of the charging transformer includes a conventional negative feed-back power transistor for constant maximum current, which is controlled by a circuit breaker 111*a*.

Thus a full description of this embodiment is unnecessary, because on the secondary side of the charging transformer it resembles FIG. 7, whilst, in addition, the end of the secondary winding $W_1$ not connected to earth, is connected through the diode $D_3$ (FIG. 8) to the end of the secondary winding 104 not connected to the spark gap 121.

Figure 15:
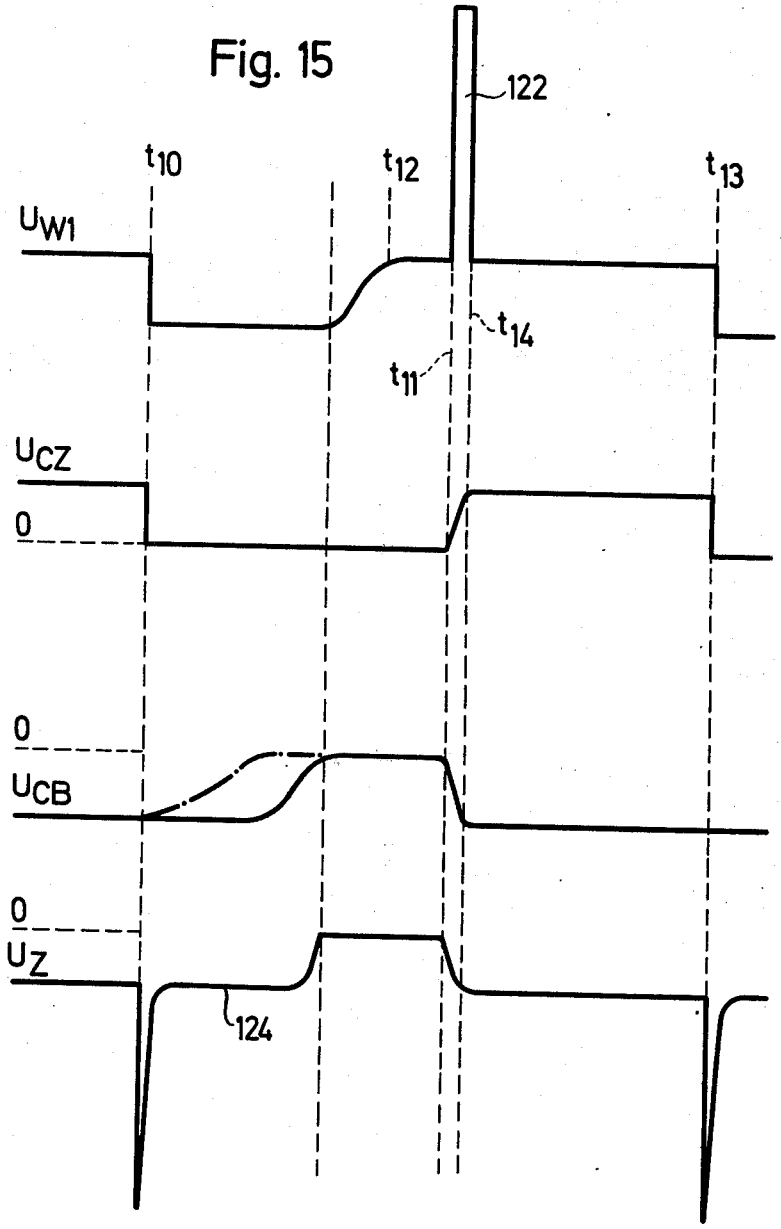
FIG. 15 shows a graph explaining the mode of operation of the circuit arrangement of FIG. 14.

The various voltage-time curves are shown in FIG. 15, i.e., the voltage $U_{w1}$ across the secondary winding $W_1$, the voltage $U_{CZ}$ across the capacitor $C_Z$, the voltage $U_{CB}$ across the capacitor $C_B$ and the voltage $U_Z$ across the spark gap 121.

The opening of the circuit breaker 111*a* is effected at the time $t_{10}$, at which thyristor 101 is fired and the voltage $U_Z$ passes from a predetermined value of, for example, −1 to −2 kV to a value of −25 kV sufficient to trigger the spark discharge. At the same time, the ignition capacitor $C_Z$ is discharged, and also capacitor $C_B$, but the latter slowly whilst supplying energy for the spark tail. The chain-dotted voltage $U_{CB}$ graph indicates how the discharge of $C_B$ would be effected if the path through the diode $D_3$ was not present, whilst the full-line graph shows the actual form of the discharge of $C_B$. It will be seen from this that the length of the spark tail 124 is increased. Since the re-charging of both capacitors $C_Z$ and $C_B$ is now effected during the control pulse 122 (FIG. 15) appearing upon the opening of the circuit breaker 111*a* at the time $t_{11}$ and at the same time the voltage $U_Z$ rises to a value of −1 kV to −2 kV, it is necessary for the voltage $U_{W1}$ to return to zero or a small value at a moment $t_{12}$ before the appearance of the control pulse, so that the spark discharge is interrupted and the energy of the blocking pulse 122 is available from the capacitors $C_Z$ and $C_B$ for a new spark discharge beginning at the time $t_{13}$. This is achieved by arranging that the circuit breaker 111*a* remains open for a longer time than is necessary to saturate the transformer 108, or at least until $t_{12}$ when the transformer 108 has saturated.

Finally, the embodiment of FIG. 16 will now be described.

This embodiment represents a simplification of the embodiment of FIG. 14, and has the advantage that only one winding $W_1$ is necessary. The mode of operation of this circuit corresponds exactly to the mode of operation of the arrangement of FIG. 14, with the same winding data as $W_1$.

The secondary side circuit arrangement of the charging transformer 108 is as follows:

Compared with FIG. 14, the charging transformer has only one secondary winding $W_1$ which is connected at one end 125 through diode $D_1$ to one terminal of capacitor $C_Z$ and at the other end 126 through diode $D_2$ polarised oppositely to diode $D_1$, to one terminal of capacitor $C_B$; the other two terminals of these capacitors are earthed. The primary winding of the ignition coil 103 is connected at one end to a terminal of the capacitor $C_Z$, and at its other end, through thyristor 101 to earth, and the terminal of the secondary winding 104 not connected to the spark gap 121 is connected to one terminal of capacitor $C_B$. A diode $(D_3)_1$ is connected in the same sense as diode $D_2$ between $D_2$ and the point 125. Finally, point 126 is connected to earth through a diode $(D_3)_2$ polarised oppositely to diode $D_2$.

The mode of operation of this embodiment is as follows:

In the blocking phase of the converter, which is located on the primary side of the charging transformer, the point 125 is positive and the point 126 negative; during this phase the capacitors $C_Z$ and $C_B$ are charged through the diodes $D_1$ and $D_2$. The voltages to which the capacitors are charged, are the inverse of the values of the capacitors. If, for example, $C_Z$ has five times the value of $C_B$ (for example, $C_Z$ is 0.25 $\mu$f and $C_B$ is 0.05 $\mu$f), then $C_Z$ is charged to az 1/5th of the voltage of $C_B$. Then the voltage at $C_Z$ is 400 volts, which is necessary to effect the initiation of the spark from the ignition coil. This moment of charging the capacitors is at point $t_{14}$ in FIG. 15. The spark is ignited at the moment $t_{10}$ or $t_{13}$ if the primary current in the charging transformer 108 is switched on, or shortly thereafter. When the primary current in the charging transformer is switched on, point 125 becomes negative and point 126 is positive. With this polarity the diodes $(D_3)_1$ and $(D_3)_2$ conduct, and current flows through a circuit formed by the following components:

The secondary winding $W_1$, diode $(D_3)_1$, the secondary winding 104, spark gap 121, earth and, finally, diode $(D_3)_2$. At the same time capacitor $C_B$ supplies an additional current (as already described in connection with FIG. 7) in the same direction which flows through the secondary winding 104 and spark gap 121.

Figure 16:
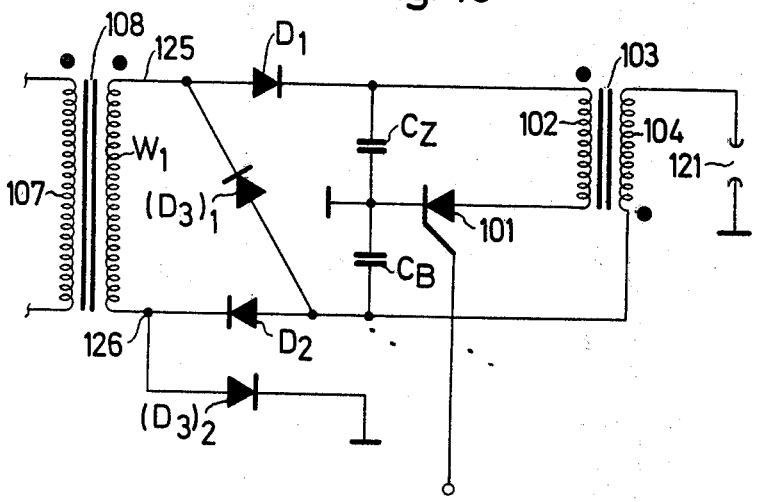
FIG. 16 shows an embodiment of the invention which corresponds in operation to the embodiment of FIG.

In the embodiment of FIG. 16 only one secondary winding $W_1$, is therefore required, i.e., only half that of the embodiment of FIG. 14. In conclusion, it may be pointed out that the direction of the transformer windings is indicated in the usual manner by dots.

FIG. 17 shows another embodiment of the present invention corresponding in its mode of operation to the embodiment of FIG. 13, but using only one transformer 108 which also acts as an ignition coil. The transmission ratio between the primary winding 107 and the secondary winding $W_1$ of the transformer 108 amounts to between 1 : 50 and 1 : 100. In parallel with the primary winding 107, which corresponds not only to the primary winding of the charging transformer 108 with the same reference numeral in FIG. 13, but also to the primary winding 102, of the ignition coil 103 in FIG. 13, the ignition capacitor $C_Z$ and the thyristor 101 are connected in series. Therefore the ignition capacitor $C_Z$ can be discharged through the primary winding 107 by means of the thyristor 101. When this happens, the secondary winding $W_1$, which corresponds to the secondary winding of the ignition coil 103 in FIG. 13 and is consequently connected in series with a spark gap 121, produces a steep negative voltage pulse peak which initiates the spark front in the spark gap 121. The energy for the spark tail is supplied by the collapsing magnetic field of the transformer 108.

In order to charge the ignition capacitor $C_Z$, it is connected, in series with the diode $D_1$, to the ends of the secondary winding $W_1$, so that the latter, as indicated by its reference numeral, also corresponds to the secondary winding of the charging transformer 108 in FIG. 13. When the transistor connected in the circuit of primary winding 107 is switched on, a positive voltage peak is produced, due to the reversed winding direction of the secondary winding $W_1$, in the secondary winding $W_1$ which charges the ignition capacitor $C_Z$ through the high tension diode $D_1$ operating in its conducting direction. The discharge of the ignition capacitor $C_Z$ is started at the moment the transistor 1 is switched off. Due to the inductance 127 in the collector-emitter circuit, which as shown is a winding of the transformer 108, a voltage peak is produced across the inductance 127 which ignites the thyristor 101 by a connection to its firing electrode.

FIG. 18 shows an embodiment providing separate sparks at two spark gaps 121 and 121', corresponding in principle to FIG. 8. Another thyristor 101' and ignition coil 103' are used in the same manner as the thyristor 101 and the ignition coil 103 coupled to the energy sources of inductive and capacitive character 108 and $C_Z$ respectively. The charging of the energy sources is effected after each spark across the spark discharge gap 121 or 121', whilst the control pulses triggering the sparks are applied to the thyristors 101 and 101' respectively according to which spark gap is to be fired.

The principle described above may be applied to other embodiments of the present invention, whilst the number of separately controllable spark gaps can be increased to any desired number.

I claim:

1. An ignition device for an internal combustion engine comprising: an internal combustion engine, an ignition coil having a primary winding and a secondary winding, said secondary winding being adapted to be connected with a spark plug of said internal combustion engine, a source of direct current, a transformer, a first switching means of periodically connecting and disconnecting said source of direct current and the primary winding of said transformer, a capacitor, said capacitor being connected in parallel with the secondary winding of said transformer, the energy developed in said transformer when said switching means is nonconductive being partly transferred to said capacitor, a second switching device having current carrying terminals being connected with said capacitor and with the primary winding of said ignition coil, whereby the stored energy of said capacitor and the remaining magnetic energy of said transformer is transferred through said second switching device into the primary winding of said ignition coil when said second switching device is biased to a conductive condition, said second switching device being biased to conduction when the voltage across said capacitor reaches a predetermined value which is substantially lower than the voltage to which said capacitor would be charged by the available energy of said transformer and wherein said second switching device is a diac.

2. An ignition device for an internal combustion engine comprising a low power ignition coil having a primary winding and a secondary winding, said secondary winding being connected with a spark gap, a source of direct current, a transformer having a primary winding and a secondary winding, a first switching device having a control terminal and being connected in series with said primary of said transformer and in series with said source of direct current, a second switching device having a pair of current carrying terminals and a control terminal, a capacitor, a charging circuit connecting said secondary winding of said transformer and said first capacitor for transferring energy from said primary winding to said capacitor when said first switching closes, a discharging circuit for discharging said capacitor into the primary winding of said ignition coil, said discharging circuit including the current carrying terminals of said second switching device, means coupling the control terminal of said second switching device to the control terminal of said first switching device whereby said second switching device is biased conductive when the first switching device opens, a circuit connecting said secondary winding of said ignition coil including a diode between said last named windings for delivering additional energy to the spark gap when said first switching device has opened.

3. The ignition device of claim 2, wherein said capacitor is a first capacitor and wherein said circuit connecting said secondary winding of said transformer and said secondary winding of said ignition coil includes a second capacitor connected between said secondary winding of said ignition coil and ground, and a second diode connecting said secondary winding of said transformer and said second capacitor such that said second diode is in conductive condition when said first switching device is closed.

4. An ignition device for an internal combustion engine comprising a low power ignition coil having a primary winding and a secondary winding, said secondary winding being connected with a spark gap, a source of direct current, a transformer having a primary winding and a secondary winding, a first switching device having a control terminal and being connected in series with said primary of said transformer and in series with said source of direct current, said first switching device and said transformer being connected as a triggerable blocking oscillator, a second switching device having a pair of current carrying terminals and a control terminal, a capacitor, a charging circuit connecting said transformer and said capacitor for transferring energy from said primary winding to said capacitor, when said blocking oscillator blocks, a discharging circuit for discharging said capacitor into the primary winding of said ignition coil including the current carrying terminals of said second switching device, means coupling the control terminal of said second switching device to the trigger input of the blocking oscillator whereby said second switching device is biased conductive when said blocking oscillator is triggered into its conductive duty cycle, a circuit connecting said secondary winding of said transformer and said secondary winding of said ignition coil including a diode between said last named windings for deliverying additional energy to the spark gap when said blocking oscillator is triggered into conductive duty cycle.

5. The ignition device of claim 4, wherein said capacitor is a first capacitor and wherein said circuit connecting said secondary winding of said transformer and said secondary winding of said ignition coil includes a second capacitor connected between said secondary winding of said ignition coil and ground, and wherein a second diode is connected between said secondary winding of said transformer and said second capacitor such that said second diode is in conductive condition when said blocking oscillator blocks.

6. The ignition device of claim 2, including a second ignition coil, wherein an additional charging circuit is connected from said transformer secondary to said capacitor and an additional discharging circuit is connected between said capacitor and second ignition coil, said discharging circuit including a third switching device.

7. The ignition device of claim 4, including a second ignition coil, wherein an additional charging circuit is connected from said transformer secondary to said capacitor and an additional discharging circuit is connected between said capacitor and second ignition coil, said discharging circuit including a third switching device.

8. An ignition device for an internal combustion engine comprising an internal combustion engine, an ignition coil having a primary and a secondary winding, said secondary winding being adapted to be connected with a spark plug of said internal combustion engine, a source of direct current, a switching device operative to periodically connect and disconnect said source of direct current and the primary winding of said ignition coil, a capacitor, a diode, a second switching device having current carrying terminals and a control terminal, the current carrying terminals of said second switching device being connected in series with said capacitor and with a tap of the primary winding of said ignition coil, whereby said capacitor discharges through said second switching device and through a part of the primary winding of said ignition coil when said second switching device is biased to conduction by a control voltage across another part of the primary winding of said ignition coil when said first switching device opens, said capacitor being recharged through said diode which is connected between the capacitor and the secondary winding of said ignition coil when said first switching device closes.

* * * * *